US007310885B2

(12) United States Patent
Tedesco et al.

(10) Patent No.: US 7,310,885 B2
(45) Date of Patent: Dec. 25, 2007

(54) FABRIC HAVING A PROCEDURE MAP

(76) Inventors: Sharon E. Tedesco, 19585 Draper Rd., Cottonwood, CA (US) 96022; Marc S. Tedesco, 19585 Draper Rd., Cottonwood, CA (US) 96022

( * ) Notice: Subject to any disclaimer, the term of this patent is extended or adjusted under 35 U.S.C. 154(b) by 0 days.

(21) Appl. No.: 11/069,196

(22) Filed: Feb. 28, 2005

(65) Prior Publication Data

US 2005/0193574 A1 Sep. 8, 2005

Related U.S. Application Data

(60) Provisional application No. 60/550,955, filed on Mar. 4, 2004.

(51) Int. Cl.
*A41H 3/00* (2006.01)
*A41H 43/00* (2006.01)

(52) U.S. Cl. ..... 33/2 R; 33/17 R

(58) Field of Classification Search ..... 33/1 B, 33/2 R, 11, 12, 17 R, 17 A, 562, 563
See application file for complete search history.

(56) References Cited

U.S. PATENT DOCUMENTS 1,616,080 A * 2/1927 Freedman ..... 33/12
2,756,434 A * 7/1956 Campins et al. ..... 33/12
4,869,726 A 9/1989 Linda et al. ..... 8/498
5,333,111 A 7/1994 Chaiken et al. ..... 364/470
5,508,936 A 4/1996 King et al. ..... 364/470
6,772,530 B2 * 8/2004 Nennig ..... 33/562
6,839,971 B2 1/2005 Schaffer et al. ..... 33/566
2004/0200081 A1 * 10/2004 Fujikuma ..... 33/2 R

OTHER PUBLICATIONS

BIFMA International, Standard for Woven Textile Characteristics, Mar. 9, 2005.

* cited by examiner

*Primary Examiner*—Christopher W Fulton
(74) *Attorney, Agent, or Firm*—T. H. P. Richardson

(57) ABSTRACT

A fabric having a procedure map which enables identification, by a machine or by a person, of one or more of the fabric characteristics, e.g. the straight of grain, true bias, up-down direction, decorative pattern characteristic, distance from a selvedge or distance along a selvedge. The procedure map facilitates accurate measuring, marking, and cutting of fabric e.g. for furniture upholstery, garments, draperies, linens and quilts.

32 Claims, 2 Drawing Sheets

FABRIC HAVING A PROCEDURE MAP

CROSS-REFERENCE TO RELATED APPLICATION

This application claims priority from U.S. Provisional Patent Application No. 60/550,955, filed Mar. 4, 2004. The entire disclosure of that application is incorporated herein by reference for all purposes.

FIELD OF THE INVENTION

This invention relates to fabrics.

BACKGROUND OF THE INVENTION

Accurate measuring, marking, and cutting of fabric is important for many applications, including upholstery of furniture and the fabrication of garments, draperies linens and quilts. Factors which need to be considered include the grain of the fabric (lines parallel to the selvedge being referred to as lengthwise straight of grain, and lines at right angles to the selvedge being referred to as crosswise straight of grain), and, in appropriate fabrics, the position and repeat of decorative patterns, and the up-down direction, particularly the nap direction.

Modern garment cutting patterns are generally supplied with instructions, e.g. directional arrows on the pattern, how the cutting pattern should be positioned on the fabric, for example relative to the straight of grain. In present practice, in order to identify the straight of grain at any point on a conventional fabric, one must either reference the selvedge, and measure and mark the straight of grain at that point, or, if there is no selvedge, find another way of determining the straight-of-grain. Identification of other fabric characteristics, e.g. a nap or lay direction, or the position and repeat of a decorative pattern, similarly requires careful and repetitive work. As a result, a significant percentage of sewn items arrive on the market with visible problems resulting from failure to correctly account for fabric characteristics such as grain, nap, decorative pattern and repeat of decorative pattern.

U.S. Pat. Nos. 4,869,726 (Linda et al) and 6,839,971 (Schafer et al) describe attempts to mitigate the problems outlined above.

SUMMARY OF THE INVENTION

This invention relates to a fabric having a procedure map thereon, the procedure map comprising at least one set of machine-make markings which identifies one or more of certain fabric characteristics, namely lengthwise straight of grain, crosswise straight of grain, true bias, position of a decorative pattern, repeat of a decorative pattern, up-down direction (e.g. nap direction), fabric width measured perpendicular to a selvedge, and fabric length measured parallel to a selvedge.

In a first preferred aspect, this invention provides a roll of woven fabric, the fabric having two selvedges and a procedure map thereon, the procedure map comprising at least one set of machine-made markings which (a) is at many points across the breadth and throughout the length of the fabric, (b) identifies at least one characteristic of the fabric, said at least one characteristic being selected from the group consisting of lengthwise straight of grain, crosswise straight of grain, true bias, position of a decorative pattern, repeat of a decorative pattern, up-down direction, fabric width measured perpendicular to a selvedge, and fabric length measured parallel to a selvedge, (c) directly contacts fibers of the fabric, and (d) is not part of a decorative pattern.

In a second preferred aspect, this invention provides a method of producing a roll of woven fabric according to the first aspect of the invention, the method comprising the steps of (A) using a machine to impart the procedure map to a run of the fabric; and (B) after step (A), rolling up the run of fabric having the procedure map thereon.

In one embodiment of the second preferred aspect of the invention, the procedure map is imparted to the fabric as part of a continuous process which includes weaving the fabric. In one example of such an embodiment, the procedure map is woven into the fabric at the same time as the fabric is being woven. In another example of such an embodiment, the fabric is woven and the procedure map is imparted to the woven fabric immediately thereafter. In another embodiment of the second preferred aspect of invention, the run of fabric is provided by unrolling an existing roll of fabric.

In a third preferred aspect, this invention provides a method of detecting a characteristic of a fabric, the method comprising (A) providing a roll of fabric according to the first preferred aspect of the invention;

(B) unrolling a run of fabric from the roll; and (C) inspecting the run of fabric with a machine which detects one or more of said at least one set of machine-made markings.

In one embodiment of the third preferred aspect of the invention, the method further comprises, simultaneously with step (C), or after step (C), (D) using a machine to cut a relatively small piece of fabric from the run of fabric, the cutting being carried out according to a cutting pattern which is referenced to the procedure map on the run of fabric.

In a fourth preferred aspect, this invention provides a method of cutting a length of fabric from a roll of fabric, the fabric (a) being a woven fabric having two selvedges, and (b) having on it a procedure map comprising at least one set of machine-made markings which (i) are on one of the selvedges, (ii) identify fabric length along the selvedge, and (iii) are sequentially numbered;

the method comprising cutting the length of fabric from the roll of fabric according to a cutting pattern which is referenced to the sequentially numbered markings.

In a fifth preferred aspect, this invention provides a fabric which has a procedure map thereon, the procedure map comprising at least one set of machine-made markings which (a) is at many points across the breadth and throughout the length of the fabric, (b) identifies at least one characteristic of the fabric, said at least one characteristic being selected from the group consisting of lengthwise straight of grain, crosswise straight of grain, true bias, position of a decorative pattern, repeat of a decorative pattern, up-down direction, fabric width measured perpendicular to a selvedge, and fabric length measured parallel to a selvedge, (b) directly contacts fibers of the fabric,
(c) is not part of a decorative pattern;

said at least one set of machine-made markings comprising a set of markings selected from the group consisting of (1) a set of markings which are invisible to the naked eye,
(2) a set of markings which can be removed by washing,
(3) a set of markings which comprise magnetic or magnetized threads,
(4) a set of markings comprising a pigment or thread visible only under ultraviolet light,
(5) a set of lengthwise straight of grain markings which are equally spaced from each other,
(6) a set of crosswise straight of grain markings which are equally spaced from each other,
(7) on a fabric having a bias, a set of markings which identifies the true bias of the fabric,
(8) on a fabric having an up-down direction, a set of markings which identifies the up-down direction of the fabric,
(9) on a fabric having a decorative pattern, a set of markings which identifies the position and/or the repeat of the decorative pattern,
(10) on a fabric having two selvedges, a set of lengthwise straight of grain markings which identify fabric widths perpendicular to a selvedge, at least one of the markings identifying a position halfway across the width, or a position quarter-way across the width or a position one third-way across the width, and
(11) on a fabric having two selvedges, a set of markings which (i) are on at least one of the selvedges, (ii) identify fabric length along one of the selvedges, and (iii) are sequentially numbered.

In preferred embodiments, this invention can provide one or more of the following functions:—

(a) a reduction in the time involved in determining the straight-of-grain at virtually any point on the fabric;
(b) a reduction in waste in the production of garments, draperies, linens, upholstery, quilts, and other sewn goods by providing immediate reference for the straight-of-grain and other orientation marks;
(c) the production of a higher quality finished product through precision grain orientation;
(d) a reduction in the need for hand measuring, and marking, by providing pre-measured markings already on the fabric, thus saving time;
(e) providing a means for accurate bias orientation consistently available to assure the proper drape by allowing the adjustment of the degree of bias desired;
(f) manual or automatic detection of straight-of-grain and other markings, depending on the use of the fabric;
(g) provision of an accurate cutting line through a grid of lengthwise and crosswise straight-of-grain lines, thus saving time at the retail level, and helping customers visually estimate yardage;
(h) increasing the efficiency of fabric use by enabling the use of fabric not having a selvedge;
(i) determination of the lay or nap orientation in the manual or automatic use of fabric via directional markings to benefit those working with fabric such as velour or velvet and the like which have a nap orientation, or those fabrics with an unidirectional decorative pattern; and
(j) enabling the scaling up and down of a grid of lengthwise and crosswise straight of grain markings to aid in the processes of quilting, by either enlarging or narrowing the distance between markings.

DETAILED DESCRIPTION OF THE INVENTION

Figure 1:
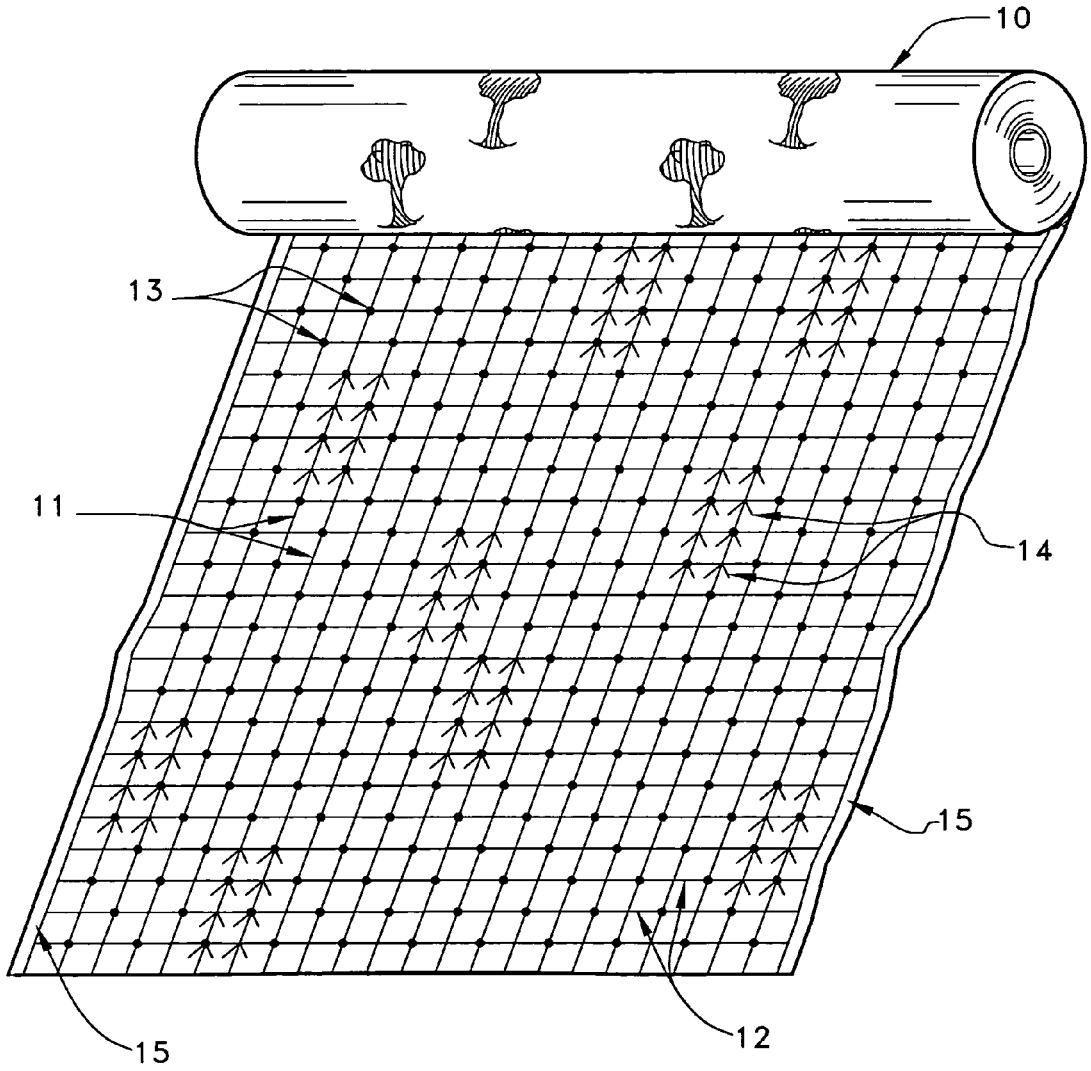
FIGS. 1 and 2 show a fabric having a procedure map thereon, with FIG. 1 showing one part of the procedure map and FIG. 2 showing the other part of the procedure map.

The form of the various markings can be the same or different. For example, each of the markings in a particular set of markings (for example the straight of grain markings) can be a continuous line or a line which is discontinuous (e.g. a line made up of dashes or dots); or can be a number of arrows (e.g. to identify the nap or lay direction, in which case the precise positioning of the arrows may not be important); or can be a number of aligned symbols (e.g. to identify the position and/or repeat of a decorative pattern). In preferred embodiments, the markings directly contact fibers of the fabric. In some embodiments, the markings are at many points across the breadth and throughout the length of the fabric and/or cover substantially the whole of the fabric. In some embodiments, the straight of grain markings are equally spaced from each other. The fabric optionally comprises a decorative pattern. When the fabric comprises a decorative pattern, the markings are not part of the decorative pattern.

Specific examples of sets of markings include one or more of the following:—

(1) a set of markings which are invisible to the naked eye,
(2) a set of markings which can be removed by washing,
(3) a set of markings which comprise magnetic or magnetized threads,
(4) a set of markings comprising a pigment or thread visible only under ultraviolet light,
(5) a set of lengthwise straight of grain markings which are equally spaced from each other,
(6) a set of crosswise straight of grain markings which are equally spaced from each other,
(7) on a fabric having a bias, a set of markings which identifies the true bias of the fabric,
(8) on a fabric having an up-down direction, a set of markings which identifies the up-down direction of the fabric,
(9) on a fabric having a decorative pattern, a set of markings which identifies the position and/or the repeat of the decorative pattern,
(10) on a fabric having two selvedges, a set of lengthwise straight of grain markings which identify fabric widths perpendicular to a selvedge, at least one of the markings identifying a position halfway across the width, or a position quarter-way across the width or a position one third-way across the width, and
(11) on a fabric having two selvedges, a set of markings which (i) are on at least one of the selvedges, (ii) identify fabric length along one of the selvedges, and (iii) are sequentially numbered.

For example, in some embodiments, the fabric has a first side having a decorative pattern thereon and an opposite second side, and the procedure map comprises a set of markings which (i) is visible only on the second side and (ii) identifies one or both of (a) the position of the decorative pattern, and (b) the repeat of the decorative pattern.

The markings are optionally such that they can be easily removed after they have served their purpose; for example they can be composed of an easily washable dye or a reactive dye. The markings are optionally visible only on one surface of a fabric, for example on the "back" side of the fabric, e.g. on the opposite side of a fabric comprising a decorative pattern intended to be viewed on the front side of the fabric. In some embodiments, the surface carrying the markings becomes the inside surface of a finished product, e.g. so that the markings cannot be seen in the finished product. In some embodiments, any markings on a finished product which remain visible to the naked eye are rendered invisible to the naked eye.

In some embodiments, the markings of the procedure map are visible to the naked eye (and can, therefore, also be detected by a suitable machine). In other embodiments, the markings are not visible to the naked eye, but can be detected by a suitable machine. The markings can for example be visible to the naked eye under ultraviolet light.

In some embodiments, the fabric is produced, e.g. by weaving, and the markings are imparted to the fabric, in a single continuous operation. Alternatively, the markings can be imparted to an existing fabric, e.g. a woven fabric, in a separate operation. In either case, an automated dye and marking system can optionally be used. Preferably, the result of the process is a roll of fabric having the markings throughout the length of the fabric on the roll.

In one embodiment, straight of grain markings are introduced during production of a woven fabric by including warp and/or woof yarns which can be distinguished from the other yarns of the fabric, e.g. by including yarns which are invisible to the naked eye, but detectable by a suitable machine.

Figure 2:
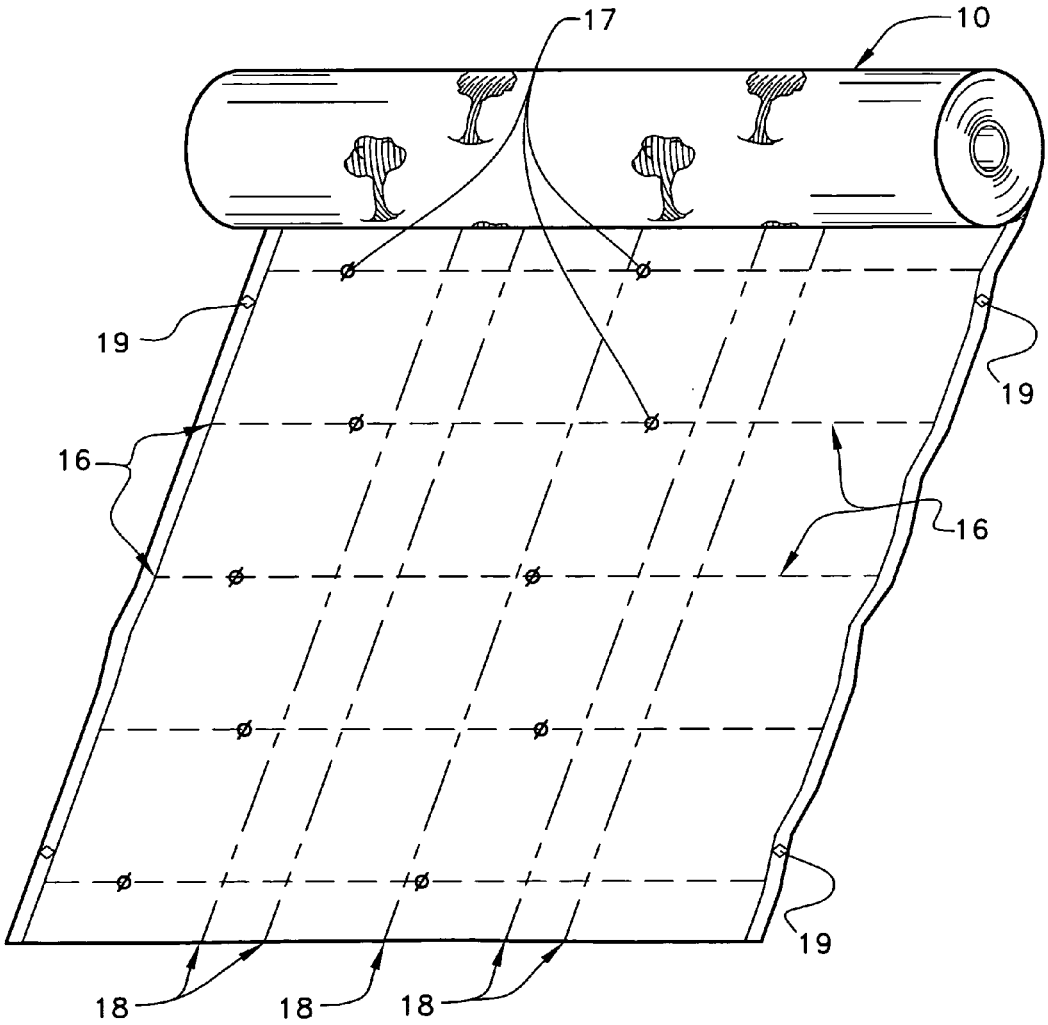

Referring now to the drawings, FIGS. 1 and 2 show a bolt of fabric 10 having a selvedge 15 at each edge. FIG. 1 shows equispaced lengthwise straight of grain markings 11 which extend the whole length of fabric; equispaced crosswise straight of grain markings which extend across the whole breadth of the fabric; and bias markings 13 showing the true bias of the fabric. FIG. 2 shows markings 16 showing the lengthwise decorative pattern repeat; markings 17 showing the crosswise decorative pattern repeat; markings 18 showing premeasured widths (center, ¼ and ⅓); and yardage measurements 19 on the selvedges.

The invention claimed is:

1. A method of producing a roll of woven fabric, the fabric having two selvedges and a procedure map on the fabric, the procedure map comprising at least one set of machine-made markings which (a) is at many points across the breadth and throughout the length of the fabric on the roll, (b) identifies at least one characteristic of the fabric, said at least one characteristic being selected from the group consisting of lengthwise straight of grain, crosswise straight of grain, true bias, position of a decorative pattern, repeat of a decorative pattern, up-down direction, fabric width measured perpendicular to a selvedge, and fabric length measured parallel to a selvedge, (b) directly contacts fibers of the fabric, and (c) is not part of a decorative pattern;

the method comprising the steps of (A) using a machine to impart the procedure map to a run of the fabric; and (B) after step (A), rolling up the run of fabric having the procedure map thereon.

2. A method according to claim 1 wherein said at least one set of markings comprising one or more sets of markings selected from the group consisting of (1) a set of lengthwise straight of grain markings which are equally spaced from each other, (2) a set of crosswise straight of grain markings which are equally spaced from each other, (3) a set of markings which identifies the true bias of the fabric, (4) on a fabric having a first side having a decorative pattern thereon and an opposite second side, a set of markings which (i) is visible only on the second side and (ii) identifies one or both of (a) position of the decorative pattern, and (b) repeat of the decorative pattern, (5) on a fabric having an up-down direction, a set of markings which identifies the up-down direction of the fabric, (6) a set of lengthwise straight of grain markings which identify fabric width perpendicular to the selvedges, at least one of the markings identifying a position halfway across the width, or a position quarter-way across the width, or a position one third-way across the width, and (7) a set of markings which (i) are on at least one of the selvedges, (ii) identify fabric length along one of the selvedges, and (iii) are sequentially numbered.

3. A method according to claim 1 wherein said at least one set of markings comprises (1) a set of lengthwise straight of grain markings which are equally spaced from each other, and (2) a set of crosswise straight of grain markings which are equally spaced from each other.

4. A method according to claim 1 wherein said at least one set of markings is invisible to the naked eye.

5. A method according to claim 1 wherein the procedure map is imparted to the fabric as part of a continuous process which includes weaving the fabric.

6. A method according to claim 5 wherein the procedure map is imparted to the fabric by weaving the procedure map into the fabric at the same time as the fabric is being woven.

7. A method according to claim 1 which comprises, before step (A)

(1) providing a roll of fabric; and (2) unrolling the run of fabric from the roll.

8. A method according to claim 1 wherein said at least one set of machine-made markings comprises incorporating a pigment or thread which can be detected only under ultraviolet light.

9. A roll of woven fabric, the fabric having two selvedges and a procedure map thereon, the procedure map comprising at least one set of machine-made markings which (a) is at many points across the breadth and throughout the length of the fabric, (b) identifies at least one characteristic of the fabric, said at least one characteristic being selected from the group consisting of lengthwise straight of grain, crosswise straight of grain, true bias, position of a decorative pattern, repeat of a decorative pattern, up-down direction, fabric width measured perpendicular to a selvedge, and fabric length measured parallel to a selvedge, (c) directly contacts fibers of the fabric, and (d) is not part of a decorative pattern.

10. A roll of fabric according to claim 9 wherein said at least one set of markings comprises one or more sets of markings selected from the group consisting of (1) a set of lengthwise straight of grain markings which are equally spaced from each other, (2) a set of crosswise straight of grain markings which are equally spaced from each other, (3) a set of markings which identifies the true bias of the fabric, (4) on a fabric having a first side having a decorative pattern thereon and an opposite second side, a set of markings which is (i) visible only on the second side, and (ii) identifies one or both of (a) position of the decorative pattern, and (b) repeat of the decorative pattern, (5) on a fabric having an up-down direction, a set of markings which identifies the up-down direction of the fabric, (6) a set of lengthwise straight of grain markings which identify fabric width perpendicular to a selvedge, at least one of the markings identifying a position halfway across the width, or a position quarter-way across the width, or a position one third-way across the width, and (7) a set of markings which (i) are on at least one of the selvedges, (ii) identify fabric length along one of the selvedges, and (iii) are sequentially numbered.

11. A roll of fabric according to claim 9 wherein the procedure map comprises (1) a set of lengthwise straight of grain markings which are equally spaced from each other, and (2) a set of crosswise straight of grain markings which are equally spaced from each other.

12. A roll of fabric according to claim 9 wherein said at least one set of markings comprises one or both of (1) on a fabric having an up-down direction, a set of markings which identifies the up-down direction; and (2) a set of markings which identifies fabric length measured parallel to the selvedge.

13. A roll of fabric according to claim 9 wherein the fabric has a first side having a decorative pattern thereon and an opposite second side, and the procedure map comprises a set of markings which is (i) visible only on the second side, and (ii) identifies one or both of (a) position of the decorative pattern, and (b) repeat of the decorative pattern.

14. A roll of fabric according to claim 9 wherein the fabric is free of decorative pattern.

15. A roll of fabric according to claim 9 wherein said at least one set of markings is invisible to the naked eye.

16. A roll of fabric according to claim 9 wherein said at least one set of markings can be removed by washing.

17. A roll of fabric according to claim 9 wherein said at least one set of machine-made markings comprises a pigment or thread which can be detected only under ultraviolet light.

18. A method of detecting a characteristic of a fabric, the method comprising (A) providing a roll of fabric, a fabric having two selvedges and a procedure map thereon, the procedure map comprising at least one set of machine-made markings which (a) is at many points across the breadth and throughout the length of the fabric on the roll, (b) identifies at least one characteristic of the fabric, said at least one characteristic being selected from the group consisting of lengthwise straight of grain, crosswise straight of grain, true bias, position of a decorative pattern, repeat of a decorative pattern, up-down direction, fabric width measured perpendicular to a selvedge, and fabric length measured parallel to a selvedge, (b) directly contacts fibers of the fabric, (c) is not part of a decorative pattern;

(B) unrolling a run of fabric from the roll; and (C) inspecting the run of fabric with a machine which detects one or more of said at least one set of machine-made markings.

19. A method according to claim 18 wherein said at least one set of machine-made markings comprises a set of markings selected from the group consisting of (1) a set of markings which are invisible to the naked eye, (2) a set of markings which can be removed by washing, and (3) a set of markings which comprise magnetic or magnetized threads.

20. A method according to claim 18 wherein said at least one set of machine-made markings comprises a set of markings selected from the group consisting of (1) a set of lengthwise straight of grain markings which are equally spaced from each other, and (2) a set of crosswise straight of grain markings which are equally spaced from each other.

21. A method according to claim 18 wherein said at least one set of machine-made markings comprises a set of markings selected from the group consisting of (1) a set of markings which identifies the true bias of the fabric, and (2) on a fabric having an up-down direction, a set of markings which identifies the up-down direction of the fabric.

22. A method according to claim 18 which further comprises, simultaneously with step (C), or after step (C), (D) using a machine to cut a relatively small piece of fabric from the run of fabric, the cutting being carried out according to a cutting pattern which is referenced to the procedure map on the run of fabric.

23. A method according to claim 18 wherein said at least one set of machine-made markings comprises a pigment or thread which can be detected only under ultraviolet light.

24. A fabric which has a procedure map thereon, the procedure map comprising at least one set of machine-made markings which (a) is at many points across the breadth and throughout the length of the fabric, (b) identifies at least one characteristic of the fabric, said at least one characteristic being selected from the group consisting of lengthwise straight of grain, crosswise straight of grain, true bias, position of a decorative pattern, repeat of a decorative pattern, up-down direction, fabric width measured perpendicular to a selvedge, and fabric length measured parallel to a selvedge, (b) directly contacts fibers of the fabric, (c) is not part of a decorative pattern;

said at least one set of machine-made markings comprising a set of markings selected from the group consisting of (1) a set of markings which are invisible to the naked eye, (2) a set of markings which can be removed by washing, (3) a set of markings which comprise magnetic or magnetized threads, (4) a set of markings comprising a pigment or thread visible only under ultraviolet light, (5) a set of lengthwise straight of grain markings which are equally spaced from each other, (6) a set of crosswise straight of grain markings which are equally spaced from each other, (7) on a fabric having a bias, a set of markings which identifies the true bias of the fabric, (8) on a fabric having an up-down direction, a set of markings which identifies the up-down direction of the fabric, (9) on a fabric having a decorative pattern, a set of markings which identifies the position and/or the repeat of the decorative pattern,

(10) on a fabric having two selvedges, a set of lengthwise straight of grain markings which identify fabric widths perpendicular to a selvedge, at least one of the markings identifying a position halfway across the width, or a position quarter-way across the width or a position one third-way across the width, and

(11) on a fabric having two selvedges, a set of markings which (i) are on at least one of the selvedges, (ii) identify fabric length along one of the selvedges, and (iii) are sequentially numbered.

25. A fabric according to claim 24 which has a first side having a decorative pattern thereon and an opposite second side; and the procedure map comprises a set of markings which (i) is visible only on the second side, and (ii) identifies one or both of (a) position of the decorative pattern, and (b) repeat of the decorative pattern.

26. A fabric according to claim 24 which is in the form of a roll.

27. A fabric according to claim 24 wherein said at least one set of markings is invisible to the naked eye.

28. A fabric according to claim 24 wherein said at least one set of markings can be removed by washing.

29. A fabric according to claim 24 wherein the procedure map comprises (1) a set of lengthwise straight of grain markings which are equally spaced from each other, and (2) a set of crosswise straight of grain markings which are equally spaced from each other.

30. A fabric according to claim 24 which has an up-down direction and wherein said at least one set of markings comprises a set of markings which identifies the up-down direction.

31. A fabric according to claim 24 wherein said at least one set of markings comprises a set of markings which identifies fabric length measured parallel to the selvedge.

32. A fabric according to claim 24 which is free of decorative pattern.

* * * * *